US005370393A

United States Patent [19]

Taylor et al.

[11] Patent Number: 5,370,393

[45] Date of Patent: Dec. 6, 1994

[54] RANDOM NUMBER SELECTION APPARATUS

[76] Inventors: James A. Taylor, Rte. 1, Box 224, Kirbyville, Tex. 75956; Earnest M. Stephen, P.O. Box 1502, Vidor, Tex. 77670

[21] Appl. No.: 225,340

[22] Filed: Apr. 8, 1994

[51] Int. Cl.[5] ..... A63F 5/04

[52] U.S. Cl. ..... 273/142 HA; 273/142 J

[58] Field of Search ..... 273/142 HA, 142 H, 142 J, 273/142 JA, 142 JB, 142 JC, 142 JD, 142 R, 139

[56] References Cited

U.S. PATENT DOCUMENTS

| | | | |
|---|---|---|---|
| D. 320,417 | 10/1991 | Beaty | D21/37 |
| 2,546,441 | 3/1951 | Guthmann | 273/142 HA |
| 3,804,419 | 4/1974 | Jackson | 273/142 HA |
| 4,239,230 | 12/1980 | Shoptaugh | 273/264 |
| 4,875,411 | 10/1989 | Turner | 273/138 A |
| 4,959,783 | 9/1990 | Scott et al. | 364/412 |
| 5,125,659 | 6/1992 | Garbee | 273/144 A |
| 5,222,738 | 6/1993 | Muller | 273/142 H |

*Primary Examiner*—Benjamin H. Layno

[57] ABSTRACT

A new and improved random number selection apparatus includes a base and an axle projecting perpendicularly from a center portion of the base. A random-number-containing wheel is supported by the axle, is juxtaposed next to the base, is rotatable on the axle, and contains a plurality of selectable numbers and a plurality of selectable wells associated with the selectable numbers. A selector wheel assembly is supported by the axle, is juxtaposed to the random-number-containing wheel, is rotatable on the axle, and includes a well-selector portion and a first number-viewing window. The well-selector portion is adapted to be manually randomly positioned in registration with a randomly chosen selectable well on the random-number-containing wheel, and the first number-viewing window is adapted to be positioned in registration with a randomly chosen selectable number on the random-number-containing wheel that is associated with the chosen well. A retainer assembly is supported by brackets connected to the base, is juxtaposed next to the selector wheel assembly, retains the selector wheel assembly and the random-number-containing wheel on the axle, and includes a second number-viewing window which is adapted to be placed in registration with the first number-viewing window for viewing a randomly chosen selectable number. A manually-held selector assembly is capable of cooperating with the well-selector portion of the selector wheel assembly for randomly choosing a selectable well on the random-number-containing wheel.

7 Claims, 3 Drawing Sheets

RANDOM NUMBER SELECTION APPARATUS

BACKGROUND OF THE INVENTION

1. Field of the Invention

The present invention relates generally to devices for selecting numbers in a random fashion and, more particularly, to devices for randomly selecting numbers for a lottery and other games of chance.

2. Description of the Prior Art

Devices for selecting numbers in a random fashion are important in games which require such randomly selected numbers, e.g. a lottery. Throughout the years, a number of innovations have been developed relating to selecting numbers in a random fashion, and the following U.S. patents are representative of some of those innovations: U.S. Pat. Nos. 4,875,411; 4,959,783; 5,125,659; and Des. 320,417. More specifically, U.S. Pat. No. 4,875,411 discloses a portable hand-operated mechanical random number selection device that also includes a mechanism for marking a lottery sheet for the indicated numbers. If merely a selection of random numbers is desired, the additional mechanical complexity provided by this device is undesirable. In this respect, it would be desirable if a portable, mechanically operated random number selection device were provided which did not include a complex paper marking mechanism.

U.S. Pat. No. 4,959,783 discloses a complex electronic random number selection device. The complexities of this device are undesirable when a simple, portable, mechanically operated random number selection device would serve the purpose. In this respect, it would be desirable of a portable, mechanically operated random number selection device were provided which does not include complex electronic circuitry.

U.S. Pat. No. 5,125,659 discloses a portable, mechanically operated random number selection device which includes a revolving drum, a plurality of number-containing disks placed inside the drum, and a slot on the drum for permitting the number-containing disks to exit from the drum in a random manner. A disadvantage of this device is that once the disks exit from the drum, they are loose and may easily be lost or misplaced. In this respect, it would be desirable if a portable, mechanically operated random number selection device were provided which does not include numbers on disks that can easily be lost or misplaced.

U.S. Pat. No. Des. 320,417 discloses a number selector for games, such as lotto, which includes numbers arranged in an ordered sequence from 1 to 49. A disadvantage of this device is that the numbers are arrayed on the device in an ordered sequence. Such an arrangement may lead to a bias of some sort. In this respect, it would be desirable if a portable, mechanically operated random number selection device were provided which included numbers arrayed in a random manner on the number selection device.

It is noted that U.S. Pat. No. 4,239,230 may be of interest for a disclosure of a peg board game. However, random number selection is not part of this peg board game.

Still other features would be desirable in a random number selection apparatus. It would be desirable for all of the numbers to be hidden from view prior to random number selection. Only after a random number is selected should the selected number be made visible.

Certain random number selection devices, such as spinners often used with board games, may provide ambiguous number selection. For example, a spinner pointer may point to a line between two numbers. Ambiguous number selection may be irritating and cause controversy between players. In this respect, it would be desirable if a portable, mechanically operated random number selection device were provided which provided unambiguous number selection.

Thus, while the foregoing body of prior art indicates it to be well known to use portable, mechanically operated random number selection devices, the prior art described above does not teach or suggest a portable, mechanically operated random number selection device which has the following combination of desirable features: (1) does not include a complex paper marking mechanism; (2) does not include complex electronic circuitry; (3) does not include numbers on disks that can easily be lost or misplaced; (4) includes numbers arrayed in a random manner on the number selection device; (5) has all of the numbers hidden from view prior to random number selection; (6) makes numbers visible only after a number has been randomly selected; and (7) provides unambiguous number selection. The foregoing desired characteristics are provided by the unique random number selection apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved random number selection apparatus which includes a base assembly and an axle assembly connected to the base assembly with the axle assembly projecting perpendicularly from a center portion of the base assembly. A random-number-containing wheel is supported by the axle assembly, is juxtaposed to the base assembly, and is adapted to rotate on the axle assembly. The random-number-containing wheel contains a plurality of selectable numbers and a plurality of selectable wells associated with the selectable numbers.

A selector wheel assembly is supported by the axle assembly, is juxtaposed to the random-number-containing wheel, and is adapted to rotate on the axle assembly. The selector wheel assembly includes a well-selector portion and a first number-viewing window. The well-selector portion is adapted to be manually randomly positioned in registration with a randomly chosen selectable well on the random-number-containing wheel, and the first number-viewing window is adapted to be positioned in registration with a randomly chosen selectable number on the random-number-containing wheel that is associated with the chosen well.

A retainer assembly is supported by the base assembly, is juxtaposed next to the selector wheel assembly, and retains the selector wheel assembly and the random-number-containing wheel on the axle assembly. The retainer assembly includes a second number-viewing window which is adapted to be placed in registration with the first number-viewing window for viewing a randomly chosen selectable number. A manually-held selector assembly is capable of cooperating with the well-selector portion of the selector wheel assembly for randomly choosing a selectable well on the random-number-containing wheel.

The plurality of numbers are distributed randomly on the random-number-containing wheel. The selectable numbers and the associated selectable wells are distributed circumferentially on the random-number-containing wheel. The well-selector portion of the selector wheel assembly is in a form of a well-selector channel that extends through the selector wheel assembly.

The manually-held selector assembly includes a handle portion. A peg portion is connected to the handle portion and adapted to be inserted in the well-selector channel of the selector wheel assembly. The manually-held selector assembly further includes a tether connected between the handle portion of the manually-held selector assembly and the axle assembly.

A bracket assembly is connected between the retainer assembly and the base assembly for supporting the retainer assembly in the base assembly.

A first bearing ring is placed on the axle assembly between the base assembly and the random-number-containing wheel. The first bearing ring provides a reduced frictional contact between the base assembly and the random-number-containing wheel when the random-number-containing wheel is rotated with respect to the base assembly. A second bearing ring is placed on the axle assembly between the random-number-containing wheel and the selector wheel assembly. The second bearing ring provides a reduced frictional contact between the selector wheel assembly and the random-number-containing wheel when the random-number-containing wheel and the selector wheel assembly are rotated with respect to each other.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved random number selection apparatus which has all of the advantages of the prior art and none of the disadvantages.

It is another object of the present invention to provide a new and improved random number selection apparatus which may be easily and efficiently manufactured and marketed.

It is a further object of the present invention to provide a new and improved random number 8election apparatus which is of durable and reliable construction.

An even further object of the present invention is to provide a new and improved random number selection apparatus which is susceptible of a low cost of manufacture with regard to both materials and labor, and which accordingly is then susceptable of low prices of sale to the consuming public, thereby making such random number selection apparatus available to the buying public.

Still yet a further object of the present invention is to provide a new and improved random number selection apparatus which does not include a complex paper marking mechanism.

Still another object of the present invention is to provide a new and improved random number selection apparatus that does not include complex electronic circuitry.

Yet another object of the present invention is to provide a new and improved random number selection apparatus which does not include numbers on disks that can easily be lost or misplaced.

Even another object of the present invention is to provide a new and improved random number selection apparatus that includes numbers arrayed in a random manner on the number selection device.

Still a further object of the present invention is to provide a new and improved random number selection apparatus which has all of the numbers hidden from view prior to random number selection.

Yet another object of the present invention is to provide a new and improved random number selection apparatus that makes numbers visible only after a number has been randomly selected.

Still another object of the present invention is to provide a new and improved random number selection apparatus which provides unambiguous number selection.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved random number selection apparatus embodying the principles and concepts of the present invention will be described.

Figure 1:
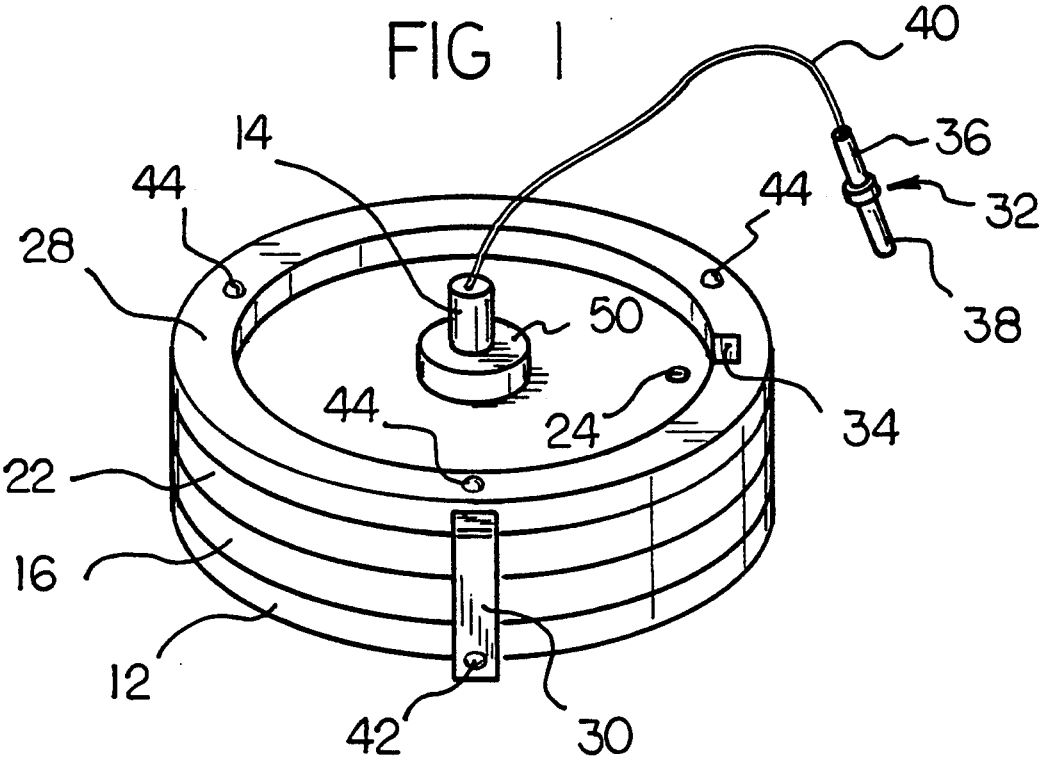
FIG. 1 is a perspective view showing a preferred embodiment of the random number selection apparatus of the invention.
Figure 2:
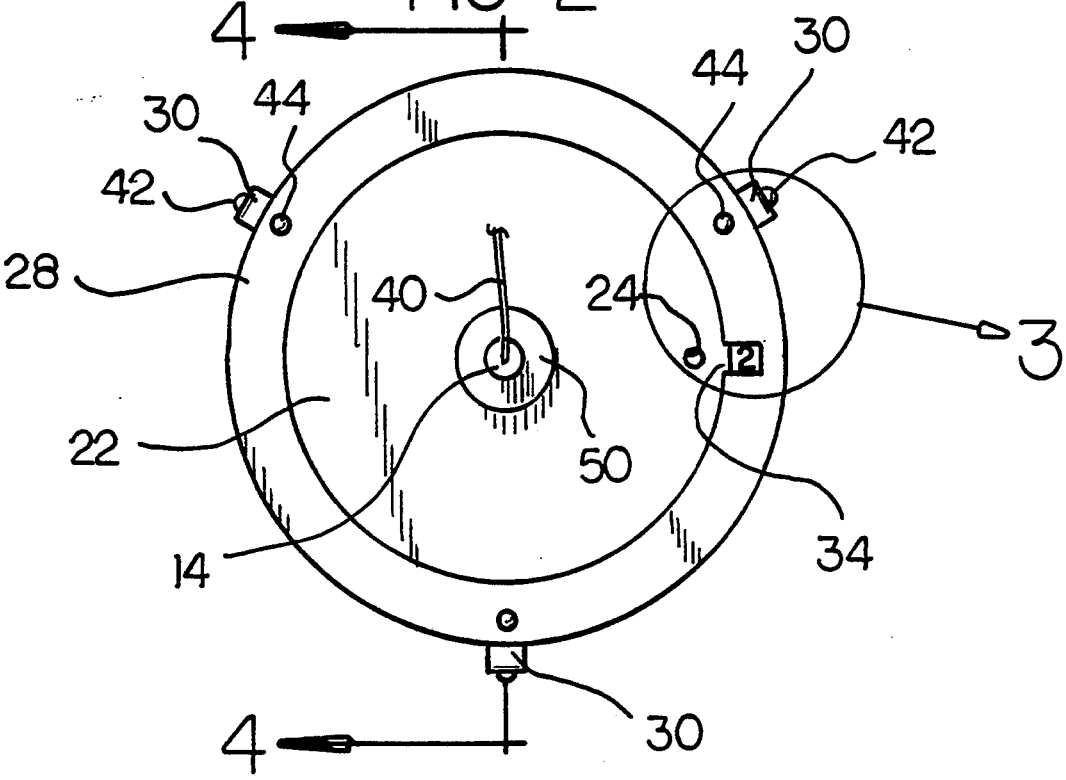
FIG. 2 is a top view of the embodiment of the random number selection apparatus shown in FIG. 1.
Figure 3:
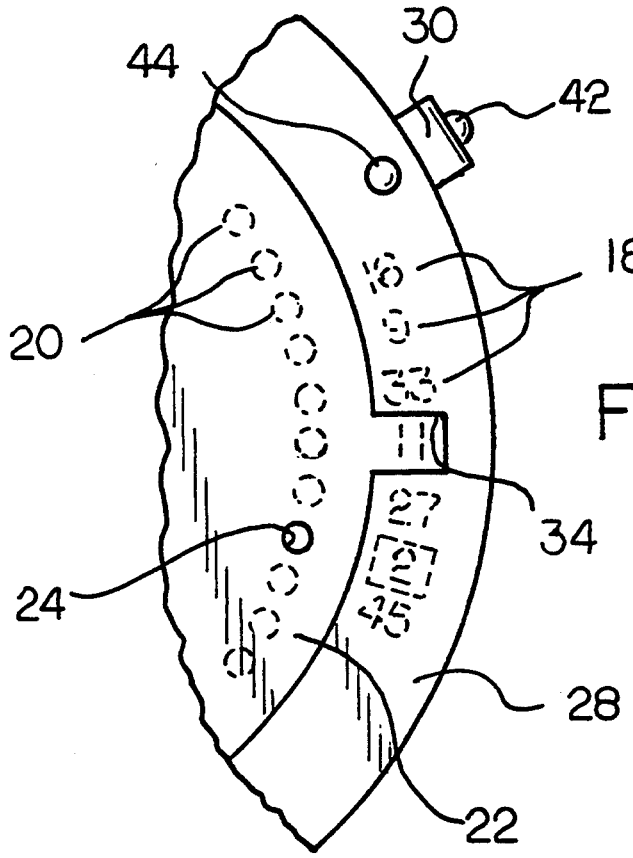
FIG. 3 is an enlarged view of the portion of the embodiment of the invention which is contained in the circled region 3 in FIG. 2.
Figure 4:
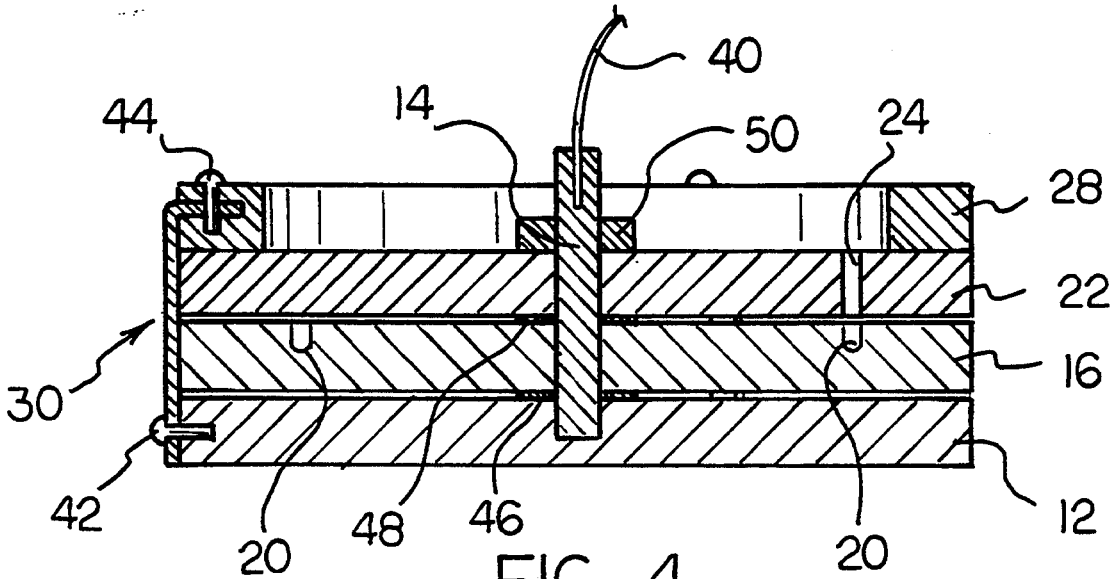
FIG. 4 is an enlarged cross-sectional view of the embodiment of the invention shown in FIG. 2 taken along line 4—4 of FIG. 2.
Figure 5:
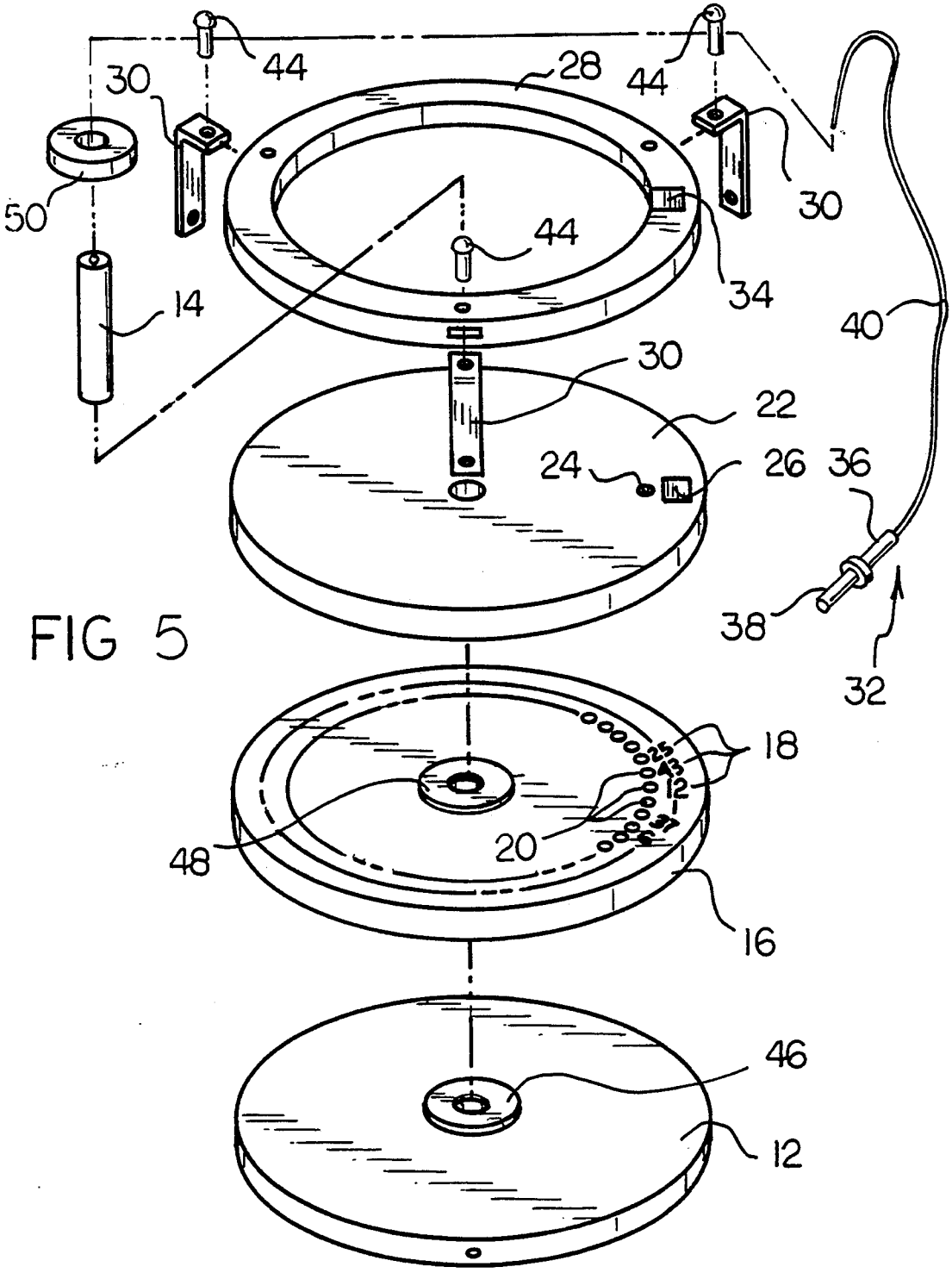
FIG. 5 is an exploded perspective view of the embodiment of the invention shown in FIG. 1.

Turning to FIGS. 1–5, there is shown an exemplary embodiment of the random number selection apparatus of the invention generally designated by reference numeral 10. In its preferred form, random number selection apparatus 10 includes a base assembly 12 and an axle assembly 14 connected to the base assembly 12 with the axle assembly 14 projecting perpendicularly from a center portion of the base assembly 12. A random-number-containing wheel 16 is supported by the axle assembly 14, is juxtaposed to the base assembly 12, and is adapted to rotate on the axle assembly 14. The random-number-containing wheel 16 contains a plurality of selectable numbers 18 and a plurality of selectable wells 20 associated with the selectable numbers 18.

A selector wheel assembly 22 is supported by the axle assembly 14, is juxtaposed to the random-number-containing wheel 16, and is adapted to rotate on the axle assembly 14. The selector wheel assembly 22 includes a well-selector portion 24 and a first number-viewing window 26. The well-selector portion 24 is adapted to be manually randomly positioned in registration with a randomly chosen selectable well 20 on the random-number-containing wheel 16, and the first number-viewing window 26 is adapted to be positioned in registration with a randomly chosen selectable number 18 on the random-number-containing wheel 16 that is associated with the chosen well 20.

A retainer assembly 28 is supported by the base assembly 12, is juxtaposed next to the selector wheel assembly 22, and retains the selector wheel assembly 22 and the random-number-containing wheel 16 on the axle assembly 14. The retainer assembly 28 includes a second number-viewing window 34 which is adapted to be placed in registration with the first number-viewing window 26 for viewing a randomly chosen selectable number 18. A manually-held selector assembly 32 is capable of cooperating with the well-selector portion 24 of the selector wheel assembly 22 for randomly choosing a selectable well 20 on the random-number-containing wheel 16.

If desired, the selectable wells 20 can be in the form of selectable channels 20 that extend completely through the random-number-containing wheel 16. The plurality of numbers are distributed randomly on the random-number-containing wheel 16. The selectable numbers 18 and the associated selectable wells 20 are distributed circumferentially on the random-number-containing wheel 16. The well-selector portion 24 of the selector wheel assembly 22 is in a form of a well-selector channel 24 that extends through the selector wheel assembly 22.

The manually-held selector assembly 32 includes a handle portion 36. A peg portion 38 is connected to the handle portion 36 and adapted to be inserted in the well-selector channel 24 of the selector wheel assembly 22. The manually-held selector assembly 32 further includes a tether 40 connected between the handle portion 36 of the manually-held selector assembly 32 and the axle assembly 14. The tether 40 prevents the manually-held selector assembly 32 from being separated from the random number selection apparatus 10 of the invention.

A bracket assembly 30 is connected between the retainer assembly 28 and the base assembly 12 for supporting the retainer assembly 28 in the base assembly 12. There are a number of bracket assemblies 30 used to connect the retainer assembly 28 to the base assembly 12. At the bottom end of a bracket assembly 30, a pin 42 affixes the bracket assembly 30 to the base assembly 12. At the top end of the bracket assembly 30, a pin 44 affixes the bracket assembly 30 to the retainer assembly 28.

A first bearing ring 46 is placed on the axle assembly 14 between the base assembly 12 and the random-number-containing wheel 16. The first bearing ring 46 provides a reduced frictional contact between the base assembly 12 and the random-number-containing wheel 16 when the random-number-containing wheel 16 is rotated with respect to the base assembly 12. A second bearing ring 48 is placed on the axle assembly 14 between the random-number-containing wheel 16 and the selector wheel assembly 22. The second bearing ring 48 provides a reduced frictional contact between the selector wheel assembly 22 and the random-number-containing wheel 16 when the random-number-containing wheel 16 and the selector wheel assembly 22 are rotated with respect to each other. The first bearing ting 46 and the second bearing ring 48 can be made from a low friction material such as Teflon(TM).

A locking ring 50 is placed on the axle assembly 14 for further securing the selector wheel assembly 22 and the random-number-containing wheel 16 on the axle assembly 14.

In using the random number selection apparatus 10 of the invention, the apparatus can be placed on a flat surface, such as a table top. The random-number-containing wheel 16 can be manually spun. Then, the handle portion 36 of the manually-held selector assembly 32 is grasped. The user partially inserts the peg portion 38 of the manually-held selector assembly 32 into the well-selector portion 24 of the selector wheel assembly 22 and spins the selector wheel assembly 22 using the manually-held selector assembly 32. When it is desired that a selectable number 18 be randomly selected, the user pushes the peg portion 38 deeper into the well-selector portion 24 of the selector wheel assembly 22 so that the distal end of the peg portion 38 engages one of the selectable wells 20 in the random-number-containing wheel 16.

Then, with the peg portion 38 of the manually-held selector assembly 32 fully inserted through the well-selector portion 24 and engaging the randomly selected selectable well 20, the interengaged selector wheel assembly 22 and random-number-containing wheel 16 are rotated by the manually-held selector assembly 32 around the axle assembly 14 so that the first number-viewing window 26 on the selector wheel assembly 22 and the second number-viewing window 34 on the retainer assembly 28 are in registration. When this is done, the randomly selected selectable number 18 that is associated with the randomly selected well 20 is visible to the user. Another number can be randomly selected by removing the peg portion 38 from the selectable well 20 and from the well-selector portion 24, by respinning the random-number-containing wheel 16, and by repeating the steps discussed above.

The components of the random number selection apparatus of the invention can be made from inexpensive and durable metal, plastic, or wood materials.

It is apparent from the above that the present invention accomplishes all of the objects set forth by providing a new and improved random number selection apparatus that is low in cost, relatively simple in design and operation, and which may advantageously be used which does not include a complex paper marking mechanism. With the invention, a random number selection apparatus is provided which does not include complex electronic circuitry. With the invention, a random number selection apparatus is provided which does not include numbers on disks that can easily be lost or misplaced. With the invention, a random number selection apparatus is provided which includes numbers arrayed in a random manner on the number selection device. With the invention, a random number selection apparatus is provided which has all of the numbers hidden from view prior to random number selection. With the invention, a random number selection apparatus is provided which makes numbers visible only after a number has been randomly selected. With the invention, a random number selection apparatus is provided which provides unambiguous number selection.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved random number selection apparatus, comprising:

a base assembly, an axle assembly connected to said base assembly, wherein said axle assembly projects perpendicularly from a center portion of said base assembly, a random-number-containing wheel, supported by said axle assembly and juxtaposed to said base assembly and adapted to rotate on said axle assembly, said random-number-containing wheel containing a plurality of selectable numbers and a plurality of selectable wells wherein each selectable number has an associated selectable wall;

a selector wheel assembly, supported by said axle assembly and juxtaposed to said random-number-containing wheel and adapted to rotate on said axle assembly, said selector wheel assembly including a well-selector portion and a first number-viewing window, wherein said selector wheel is adapted to cover from view said plurality of selectable numbers during rotation except at said first number-viewing window, wherein said well-selector portion is adapted to be manually randomly positioned in registration with a randomly chosen selectable well on said random-number-containing wheel, and wherein said first number-viewing window is adapted to be positioned in registration with a randomly chosen selectable number on said random-number-containing wheel that is associated with the chosen well, a retainer assembly, supported by said base assembly and juxtaposed next to said selector wheel assembly, for retaining said selector wheel assembly and said random-number-containing wheel on said axle assembly, said retainer assembly including a second number-viewing window, wherein said retainer assembly is adapted to cover from view said first number-viewing window during rotation of said selector wheel except at said second number-viewing window, wherein said second number-viewing window is adapted to be placed in registration with said first number-viewing window for viewing a randomly chosen selectable number, and a manually-held selector assembly capable of cooperating with said well-selector portion of said selector wheel assembly and any one of said selectable walls of said random number containing wheel for randomly choosing a selectable well on said random-number-containing wheel.

2. The apparatus described in claim 1 wherein said plurality of numbers are distributed randomly on said random-number-containing wheel.

3. The apparatus described in claim 1 wherein said selectable numbers and said associated selectable wells are distributed circumferentially on said random-number-containing wheel.

4. The apparatus described in claim 1 wherein:

said well-selector portion of said selector wheel assembly is in a form of a well-selector channel that extends through said selector wheel assembly, and said manually-held selector assembly includes a handle portion, a peg portion connected to said handle portion and adapted to be inserted in said well-selector channel of said selector wheel assembly.

5. The apparatus described in claim 4 wherein said manually-held selector assembly further includes a tether connected between said handle portion of said manually-held selector assembly and said axle assembly.

6. The apparatus described in claim 1, further including:

a bracket assembly connected between said retainer assembly and said base assembly for supporting said retainer assembly in said base assembly.

7. The apparatus described in claim 1, further including:

a first bearing ring placed on said axle assembly between said base assembly and said random-number-containing wheel, wherein said first bearing ring provides a reduced frictional contact between said base assembly and said random-number-containing wheel when said random-number-containing wheel is rotated with respect to said base assembly, and a second bearing ring placed on said axle assembly between said random-number-containing wheel and said selector wheel assembly, wherein second bearing ring provides a reduced frictional contact between said selector wheel assembly and said random-number-containing wheel when said random-number-containing wheel and said selector wheel assembly are rotated with respect to each other.

* * * * *